US010611602B2

(12) United States Patent
Jimenez-Gonzalez et al.

(10) Patent No.: US 10,611,602 B2
(45) Date of Patent: Apr. 7, 2020

(54) MOVABLE CAR MOUNTED OVERSPEED GOVERNOR

(71) Applicants: Otis Elevator Company, Farmington, CT (US); Agustin Jimenez-Gonzalez, Madrid (ES)

(72) Inventors: Agustin Jimenez-Gonzalez, Madrid (ES); Juan Jose Fernandez, Madrid (ES); Antonio de Miguel Urquijo, Madrid (ES)

(73) Assignee: OTIS ELEVATOR COMPANY, Farmington, CT (US)

( * ) Notice: Subject to any disclaimer, the term of this patent is extended or adjusted under 35 U.S.C. 154(b) by 371 days.

(21) Appl. No.: 15/554,327

(22) PCT Filed: Mar. 12, 2015

(86) PCT No.: PCT/ES2015/070178

§ 371 (c)(1),
(2) Date: Aug. 29, 2017

(87) PCT Pub. No.: WO2016/142557

PCT Pub. Date: Sep. 15, 2016

(65) Prior Publication Data

US 2018/0044135 A1 Feb. 15, 2018

(51) Int. Cl.
*B66B 5/04* (2006.01)
*B66B 5/00* (2006.01)

(52) U.S. Cl.
CPC ..... *B66B 5/044* (2013.01); *B66B 5/0087* (2013.01)

(58) Field of Classification Search
CPC ..... B66B 5/044; B66B 5/0087
USPC ..... 187/393
See application file for complete search history.

(56) References Cited

U.S. PATENT DOCUMENTS

| | | | | |
|---|---|---|---|---|
| 5,065,845 | A | 11/1991 | Pearson | |
| 6,223,860 | B1 | 5/2001 | Namba et al. | |
| 6,478,117 | B2 | 11/2002 | Swaybill | |
| 2013/0098711 | A1* | 4/2013 | Aguado | B66B 5/044 187/373 |
| 2015/0136544 | A1* | 5/2015 | Dube | B66B 5/044 188/180 |
| 2017/0225923 | A1* | 8/2017 | Fauconnet | B66B 5/0087 |

(Continued)

FOREIGN PATENT DOCUMENTS

| | | |
|---|---|---|
| CN | 104229580 A | 12/2014 |
| EP | 0990615 | 4/2000 |
| EP | 1016614 | 7/2000 |

(Continued)

OTHER PUBLICATIONS

International Search Report, International Application No. PCT/ES2015/070178, dated Nov. 9, 2015, European Patent Office; International Search Report 4 pages, Written Opinion 5 pages.

*Primary Examiner* — Jeffrey Donels
(74) *Attorney, Agent, or Firm* — Cantor Colburn LLP

(57) ABSTRACT

A movable car mounted governor assembly for an elevator car is provided. The assembly includes a chassis releasably mounted to an upright of an elevator car and a governor operationally mounted to the chassis. The chassis is configured to move from a first position to a second position relative the upright, wherein in the first position the chassis is fixedly secured to the upright and in the second position the chassis is not fixedly secured to the upright.

20 Claims, 6 Drawing Sheets

(56) References Cited

U.S. PATENT DOCUMENTS

2018/0319626 A1* 11/2018 Shiraishi ..... B66B 5/044

FOREIGN PATENT DOCUMENTS

| | | | |
|---|---|---|---|
| EP | 1439144 | A2 | 7/2004 |
| JP | 2002020056 | A | 1/2002 |
| JP | 2002338156 | | 11/2002 |
| WO | 2011146050 | A1 | 11/2011 |
| WO | 2013180721 | A1 | 12/2013 |
| WO | 2014195530 | A1 | 12/2014 |

* cited by examiner

MOVABLE CAR MOUNTED OVERSPEED GOVERNOR

CROSS REFERENCE TO RELATED APPLICATIONS

This is a U.S. National Stage of Application No. PCT/ES2015/070178, filed on Mar. 12, 2015, the disclosure of which is incorporated herein by reference in its entirety.

BACKGROUND OF THE INVENTION

Embodiments are directed to car mounted overspeed governors for elevator cars and particularly to movable car mounted overspeed governor assemblies for elevator cars.

Elevators typically include a safety system to stop an elevator from traveling at excessive speeds in response to an elevator component breaking or otherwise becoming inoperative, or deviations from an intended motion profile due to motion control software errors. Traditionally, elevator safety systems include a mechanical speed sensing device commonly referred to as an overspeed governor, a governor rope, and a mechanical linkage connected to a safety gear for selectively frictionally engaging elevator guiderails. The overspeed governor is traditionally mounted either in a machine room or in the top or bottom of the hoistway. The safety system is mounted on the car, and a linkage or governor rope hitch connects the system with the governor. When the governor detects a dangerous situation due to excessive travelling speed, it sends a force to the safety gear through the tensioned governor rope and linkage. The safety gear then engages the guiderails and stops the elevator car.

A recent advance in elevator safety is the car mounted overspeed governor. By mounting the overspeed governor on elevator car, it can be directly linked to the safety gear also on the elevator car, minimizing delays in activating the safety gear once an overspeed condition has been reached. In past elevator systems, where the overspeed governor is mounted at the top of the elevator shaft or in a machine room, the overspeed governor was linked through a linkage to the safety gear by connection to a rope, which sometimes caused delays in activating the safety gear after reaching an overspeed due to the length and elasticity of the rope. Additional benefits of the car mounted overspeed governor include a reduction in the amount of governor rope required (a single length of rope for an elevator car compared to an entire governor rope loop); the ability to install the governor at the factory, rather than in the field; and the reduction in complexity of safety linkages by eliminating the need for springs to resist the inertial forces of the governor rope loop during a sudden stop.

BRIEF DESCRIPTION OF THE INVENTION

According to one embodiment a movable car mounted governor assembly for an elevator car is provided. The assembly includes a chassis releasably mounted to an upright of an elevator car and a governor operationally mounted to the chassis. The chassis is configured to move from a first position to a second position relative the upright, wherein in the first position the chassis is fixedly secured to the upright and in the second position the chassis is not fixedly secured to the upright.

In addition to one or more of the features described above, or as an alternative, further embodiments may include, wherein the first position is an operational position of the governor.

In addition to one or more of the features described above, or as an alternative, further embodiments may include, wherein the second position is a maintenance position of the governor.

In addition to one or more of the features described above, or as an alternative, further embodiments may include, wherein the second position is configured to enable access to the governor from an interior of the elevator car.

In addition to one or more of the features described above, or as an alternative, further embodiments may include a roller operationally connected to the chassis and configured to enable the chassis to slide relative to the upright between the first and second positions.

In addition to one or more of the features described above, or as an alternative, further embodiments may include, wherein the roller is configured to slide along a rail that is fixed to the upright.

In addition to one or more of the features described above, or as an alternative, further embodiments may include, wherein a top of the chassis is substantially level with a top of the elevator car when in the first position.

In addition to one or more of the features described above, or as an alternative, further embodiments may include at least one fastener configured to fixedly secure the chassis in the first position and being disengageable to enable the chassis to move to the second position.

In addition to one or more of the features described above, or as an alternative, further embodiments may include a stop configured to locate the chassis in the first position.

In addition to one or more of the features described above, or as an alternative, further embodiments may include, wherein the stop is configured to support the chassis in the first position.

In addition to one or more of the features described above, or as an alternative, further embodiments may include, wherein the movement of the chassis is a rotation from the first position to the second position.

In addition to one or more of the features described above, or as an alternative, further embodiments may include, wherein the movement of the chassis is a vertical sliding motion from the first position to the second position.

According to another embodiment, a method of accessing a car mounted governor assembly of an elevator car is provided. The method includes disengaging at least one fastener to release a car mounted governor assembly from an upright of an elevator car, moving the assembly from a first position to a second position with respect to the upright, moving the assembly from the second position to the first position, and reengaging the at least one fastener to fixedly secure the assembly to the upright.

In addition to one or more of the features described above, or as an alternative, further embodiments may include, wherein the first position is an operational position of the governor and the second position is a maintenance position of the governor.

In addition to one or more of the features described above, or as an alternative, further embodiments may include, wherein the steps of moving comprise at least one of (i) slidably moving and (ii) rotating the chassis between the first and second positions.

Technical effects of embodiments of the invention include providing a car mounted overspeed governor that is simply installed and accessible for maintenance and inspection purposes. Further, technical effects of embodiments of the invention include a reduced size and optimized location of a car mounted overspeed governor.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

Figure 1:
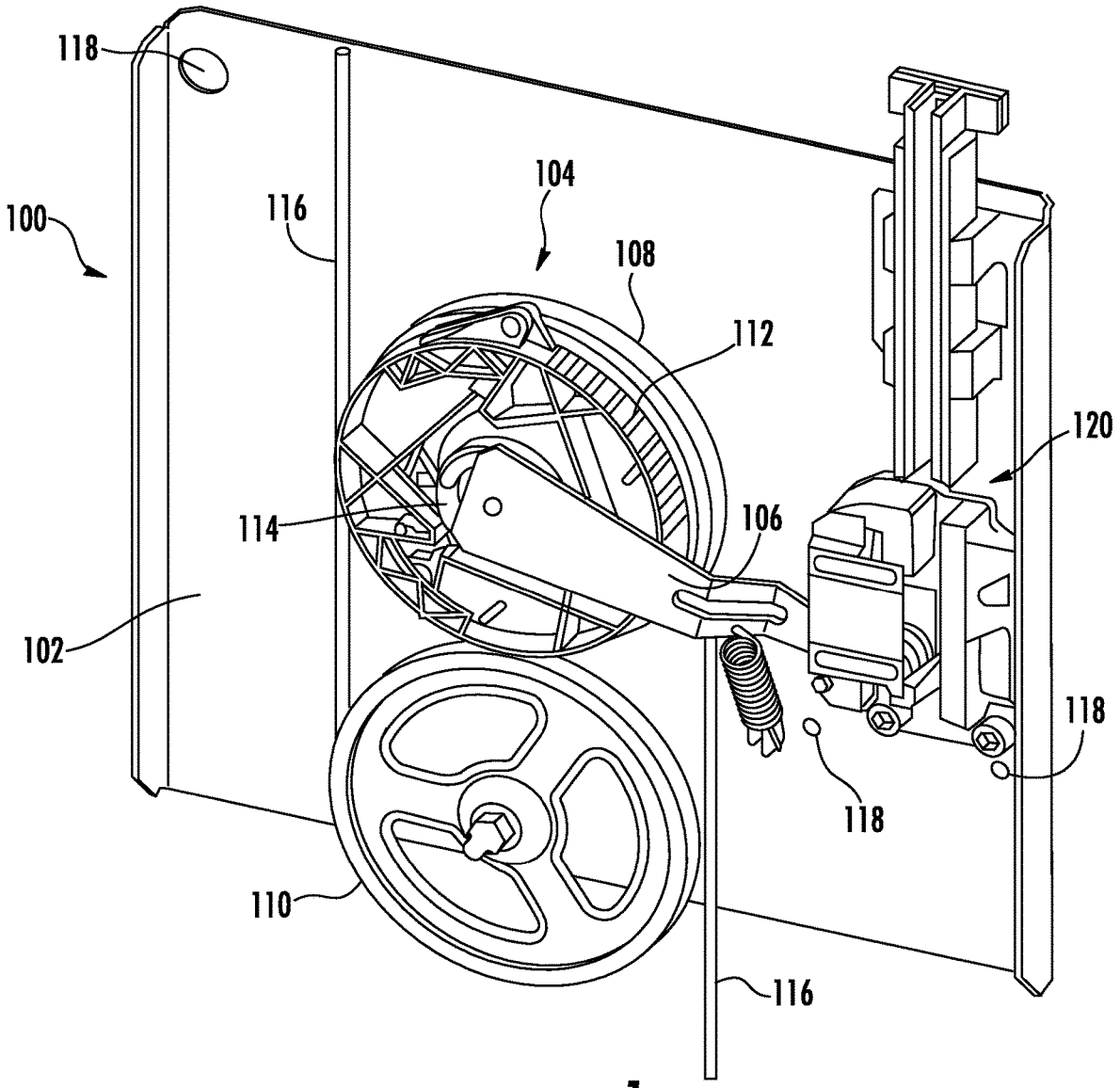
FIG. 1 is a perspective view of a car mounted governor assembly and safety gear.

FIG. 1 is a perspective view of a car mounted overspeed governor assembly 100 which is configured to provide a safety feature to elevator cars. In operation, the car mounted overspeed governor assembly 100 enables the efficient stopping of an elevator car during an overspeed event.

To provide such functionality, FIG. 1 illustrates a chassis 102 supporting a governor 104. The governor 104 includes a safety lever 106, a tripping sheave 108, idler sheave 110, centrifugal tripping mechanism 112, and a tripping ring 114. Also shown in FIG. 1 is a cable 116, which may be a cable, rope, wire, etc. that is configured to extend between the top and bottom of an elevator shaft or hoistway.

The chassis 102 is configured to be attached to an outside surface, structure, or side of an elevator car, such as an upright of the elevator car (see, e.g., FIG. 2A) near a guiderail upon which the elevator car travels. The chassis 102 can be sheet metal and includes attachment points for the governor 104 and associated components. Further, the chassis 102 can include one or more apertures 118 configured to attach the chassis 102, and thus governor 104, to the structure or surface of the elevator.

The chassis 102 also supports a safety device 120 that is configured to engage or trigger in an overspeed condition of the elevator, to thus provide a safety mechanism employing the governor 104. In an exemplary embodiment, the triggering device may include a centrifugal tripping mechanism attached to the tripping sheave 108 which is rotatably mounted to the chassis 102. The idler sheave 110 is also rotatably mounted to the chassis 102 and adjacent to tripping sheave 108, as shown in FIG. 1. The cable 116 may be anchored at a top of an elevator shaft or hoistway and may be free hanging. The cable 116 may further be tensioned by a mass at a bottom of the elevator shaft or hoistway. At the car mounted governor assembly 100, the cable 116 travels around tripping sheave 108 and idler sheave 116 in an "S"-like pattern or winding. For example, the cable 116 extends downward on the left side of FIG. 1, wraps around the bottom of idler sheave 116, winds upward and to the left in FIG. 1, wraps around tripping sheave 108, and then extends downward on the right side of the tripping sheave 108.

In operation, as an elevator car moves up and down within an elevator shaft or hoistway, the cable 116 copies or transfers the elevator car speed to the governor 104 by looping around the tripping sheave 108 and the idler sheave 110, as described above. The centrifugal tripping mechanism 112 rotates with the tripping sheave 108. In the event of an overspeed condition as the elevator car descends, the centrifugal tripping mechanism 112 couples tripping sheave 108 to tripping ring 114. Once coupled, the tripping ring 114 moves with the tripping sheave 108, both rotating in a counterclockwise direction in FIG. 1. The force of the rotation from the tripping ring 114 is transferred to the safety lever 106. The counterclockwise movement of the safety lever 106 then causes the safety device 120 to frictionally engage with a guiderail or other structure in the shaft or hoistway to slow down or stop the elevator car.

As noted, in the exemplary embodiment of FIG. 1, the car mounted governor assembly 100 may be fixedly mounted or attached to an upright of the elevator car. To accomplish this, multiple fasteners, such as screws, bolts, rivets, adhesives, bonding, etc. may be used to fixedly secure the chassis 102 to the upright. As a consequence of employing such fasteners or other means of securing, it may be impossible to move the car mounted governor assembly without disassembling the component parts thereof. However, the car mounted governor assembly must be reachable by technicians to perform inspections and/or maintenance. As a result, the car mounted governor assembly may be mounted or located at positions on the exterior of an elevator car that may not be optimal. For example, the car mounted governor may be located above or below the elevator car, thus reducing the usable space within the shaft or hoistway. Alternatively, to enable maximum shaft or hoistway space, the car mounted governor assembly may be located at difficult to reach location, which may decrease the safety and/or efficiency of performing maintenance and/or inspections on the car mounted governor assembly. Alternatively, a special design may be required to enable placement of a car mounted governor assembly in a more convenient location, but such designs may make the car mounted governor assembly more complicated, resulting in higher costs to manufacture and/or install and/or may result in higher costs and/or difficulties in performing maintenance and/or inspections on the car mounted governor assembly.

Figure 2A:
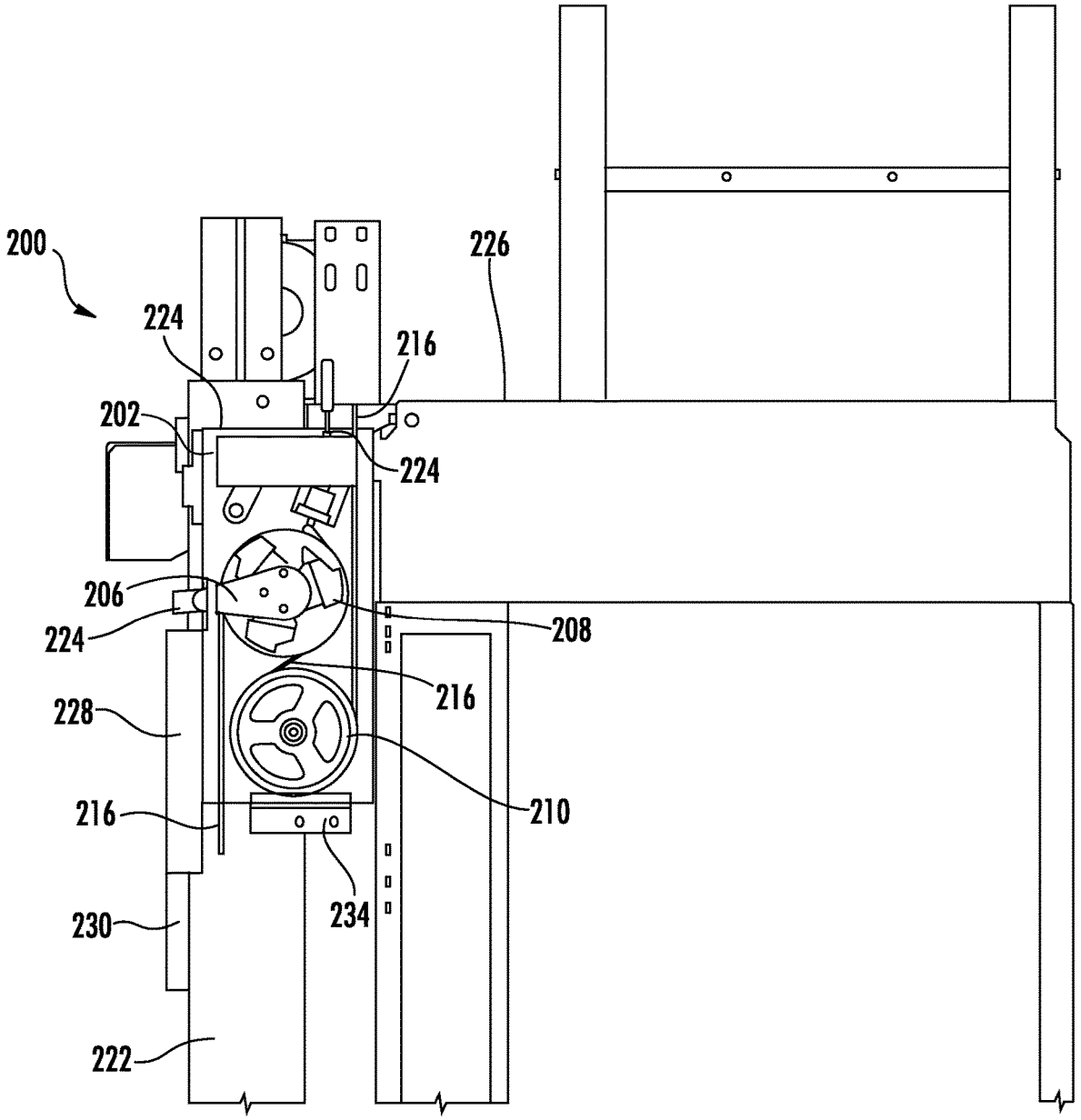
FIG. 2A is a side view of a car mounted governor assembly in accordance with an exemplary embodiment of the invention in a first position.
Figure 2B:
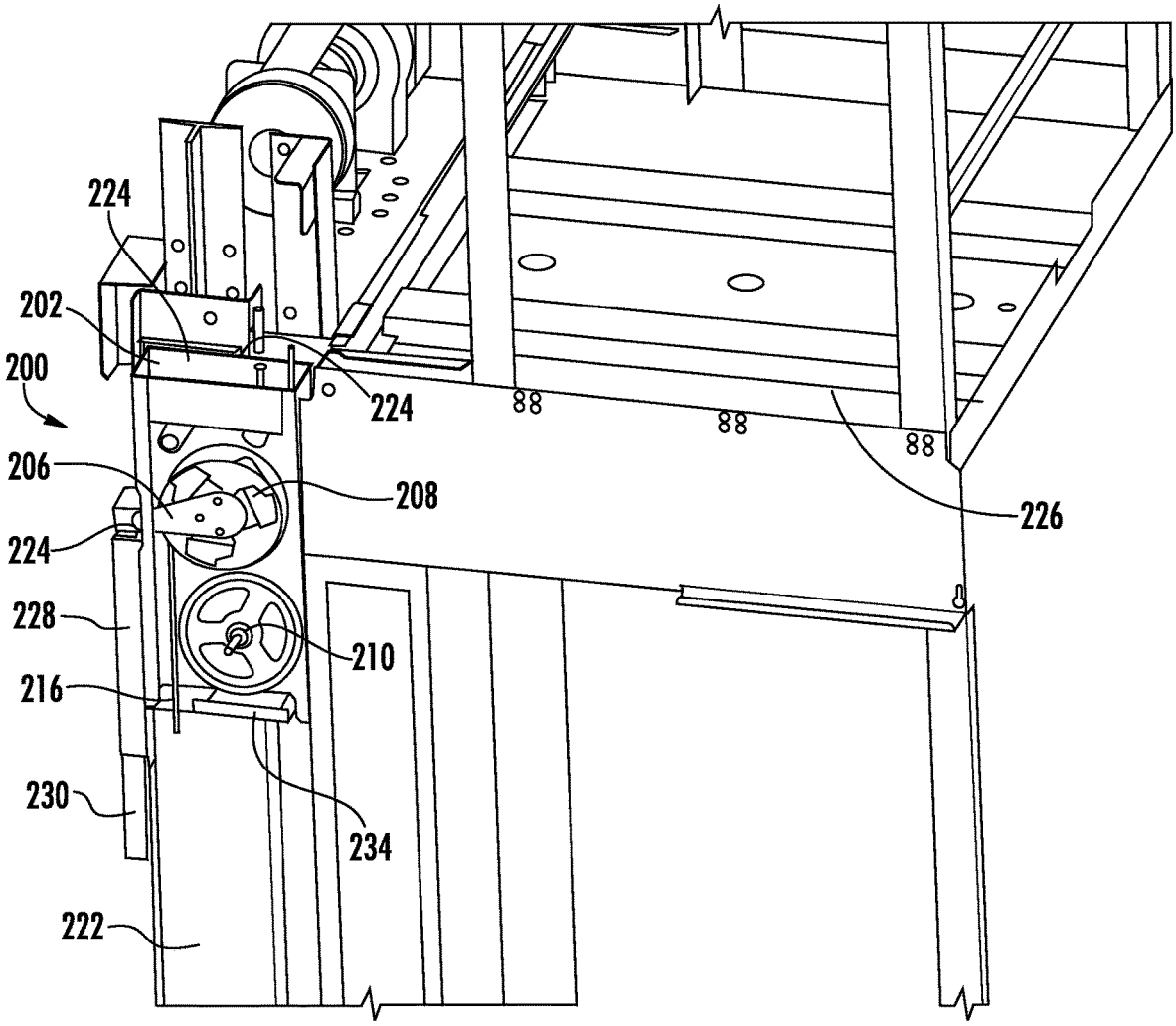
FIG. 2B is a perspective view of the car mounted governor assembly of FIG. 2A in the first position.
Figure 2C:
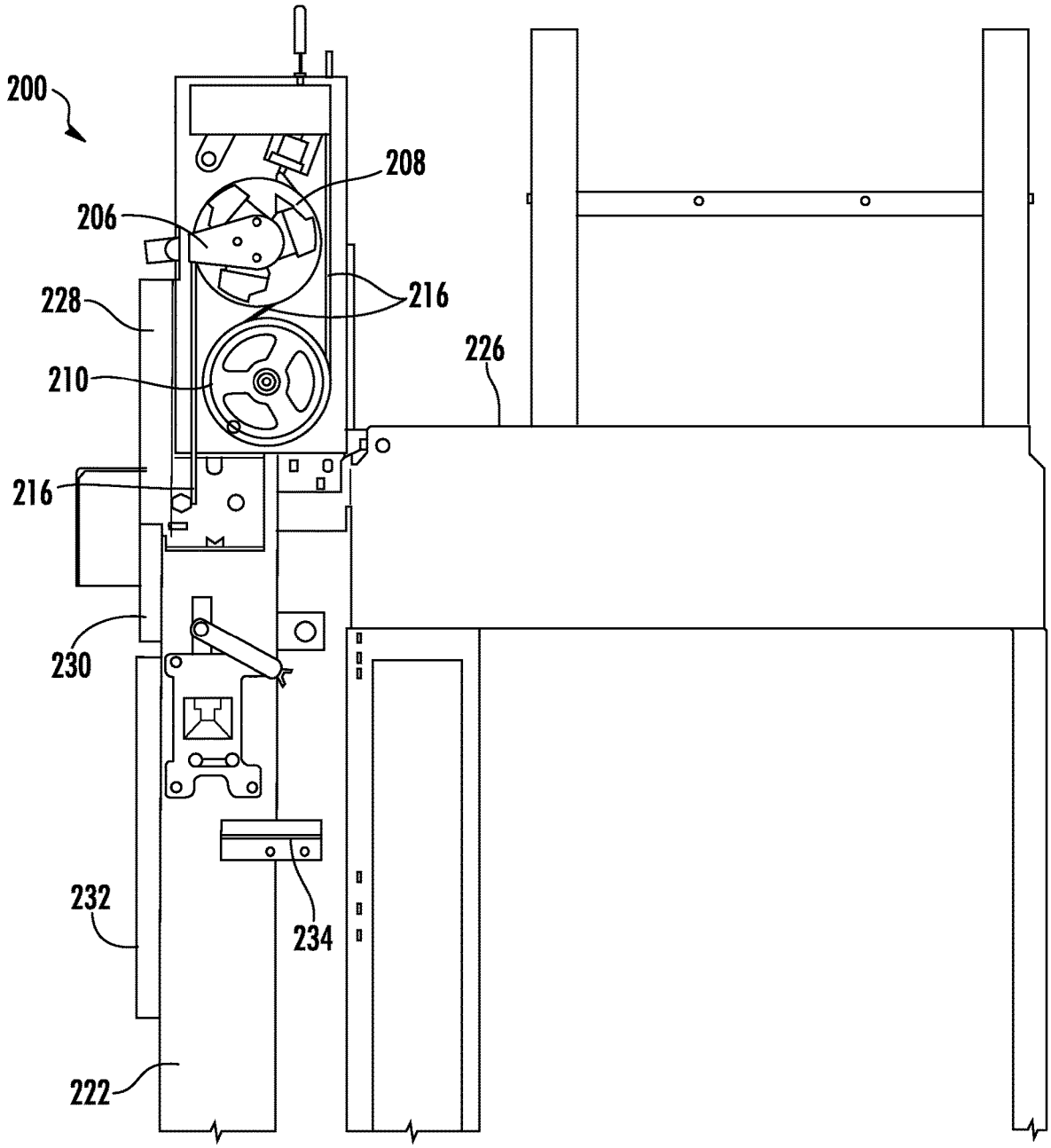
FIG. 2C is a side view of the car mounted governor assembly of FIG. 2A, but in a second position.
Figure 2D:
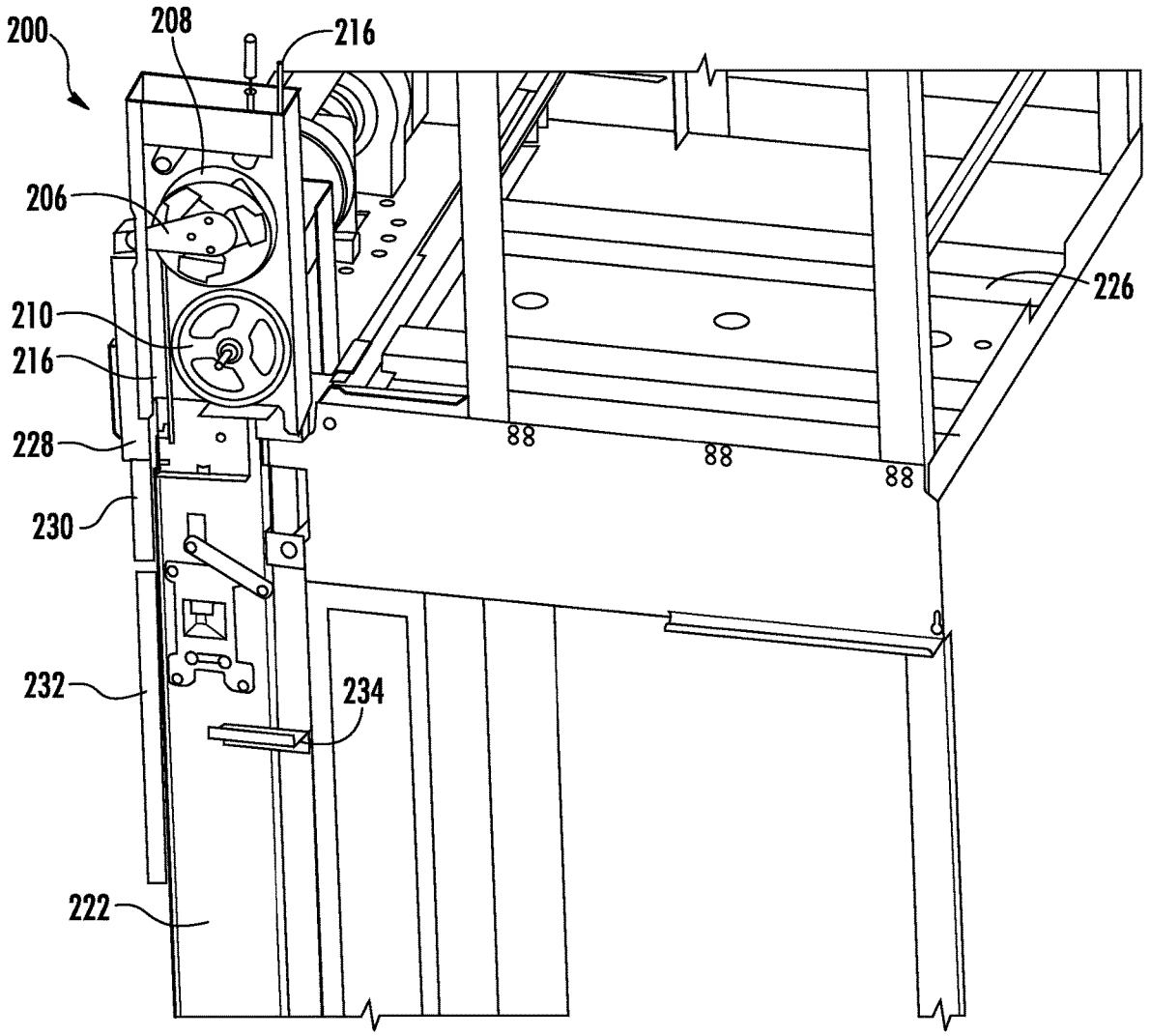
FIG. 2D is a perspective view of the car mounted governor assembly of FIG. 2A in the second position.

Turning now to FIGS. 2A, 2B, 2C, and 2D, a car mounted governor assembly 200 in accordance with an exemplary embodiment of the invention is shown. FIG. 2A shows a side or profile view of the car mounted governor assembly 200 in a first position. FIG. 2B shows a perspective view of the car mounted governor assembly 200 of FIG. 2A in the first position. FIG. 2C shows a side or profile view of the car mounted governor assembly 200 of FIG. 2A in a second position. FIG. 2D shows a perspective view of the car mounted governor assembly 200 of FIG. 2A in the second position.

The car mounted governor assembly 200 includes similar features to the car mounted governor assembly 100 of FIG. 1, and thus the similar features will be labeled with like reference numbers but preceded by a "2" rather than a "1." For example, a chassis 202 is configured to support a governor 204 which includes a tripping sheave 208 and an idler sheave 210. A cable 216 is wound through the tripping sheave 208 and the idler sheave 210, as described above with respect to FIG. 1. The tripping sheave 208 also includes a safety lever 206. In operation, the car mounted governor assembly 200 operates substantially similarly to the car mounted governor assembly 100 of FIG. 1, and thus other features and components may be similar, except, for example, as described below.

In one aspect, the chassis 202 of the car mounted governor assembly 200 of FIG. 2 is relatively narrower than the car mounted governor assembly 100 of FIG. 1. This configuration of the chassis 202 enables installation of the car mounted governor assembly 200 in a smaller volume or area on an elevator car, i.e., the assembly 200 occupies less space, or at different locations on the elevator car. Although shown as a relatively narrow configuration, those of skill in the art will appreciate that any dimensions, shapes, and/or configurations of the car mounted governor assembly may be employed without departing from the scope of the invention.

As shown in FIG. 2A, the car mounted governor assembly 200 is releasably and moveably mounted to an upright 222 of an elevator car. The car mounted governor assembly 200 fixedly attaches, engages, and/or mounts to the upright 222 by one or more fasteners 224. The fasteners 224 are configured to securely lock, engage, mount, attach, and/or maintain the car mounted governor assembly 200 in place in a first position (FIGS. 2A, 2B). The first position, in some embodiments, is an operational position. In the operational position, the fasteners 224 are configured to enable the car mounted governor assembly 200 to operate as a safety mechanism in the event of an overspeed occurrence. The fasteners 224 may be screws, bolts, lock and pin configurations, or any other type of removable or releasable fastener known in the art.

The chassis 202 is supported, in part, in the first position on one side, such as the bottom of the chassis 202, by a stop 234. When the chassis 202 abuts or is held or retained by the stop 234, in the first position, a top of the chassis 202 is level with, substantially level with, or near a top of an elevator car 226. By locating and mounting the chassis 202 in such a position, a technician may be provided with easy access to the fasteners 224 when performing inspection and/or maintenance operations of the car mounted governor assembly 200. Additionally, such position minimizes the impact the car mounted governor assembly has on the entire elevator car structure, volume occupied, and configuration. For example, the location or position of the first position, which may be a fixed or operational position of the car mounted governor assembly, is not restricted as much as other configurations of car mounted governor assemblies that occupy a larger volume or area. Further, such a reduced dimension car mounted governor assembly may make better or more efficient use of hoistway or shaft dimensions and space, thus enabling larger elevator car cabins.

In other embodiments, the chassis 202 may be located at other locations on the elevator car 226. For example, in some embodiments, the chassis 202 may be located at a position where the car mounted governor assembly 200 is accessible from the interior of the elevator car 226. Thus, in some embodiments, the elevator car 226 may include a portion or may be configured to be opened and/or modifiable such that the car mounted governor assembly 200 is reachable from the interior of the elevator car 226. As such, a technician may be able to access the car mounted governor assembly 200 without the need to be directly within an elevator shaft. In some such embodiments, the chassis 202 may be configured to slide horizontally, slide downward, swing, pivot, etc. Thus, FIGS. 2A-2D are merely presented for illustrative and explanatory purposes and those of skill in the art will appreciate that other configurations, movements, etc. may be employed without departing from the scope of the invention.

In the first position, shown in FIGS. 2A and 2B, the car mounted governor assembly 200 is fixed and/or secured relative to the elevator car by fasteners 224 and stop 234. However, the car mounted governor assembly 200 may require maintenance and/or inspection. Thus, in accordance with embodiments of the invention, the car mounted governor assembly 200 is configured to be movable or adjustable away from the first position for the purpose of allowing access to the components of the car mounted governor assembly 200, e.g., for inspection and/or maintenance.

Referring now to FIGS. 2C and 2D, the car mounted governor assembly 200 is shown in a second position. The second position may be a maintenance position where a technician can easily access the components and features of the car mounted governor assembly 200 without disassembling the assembly 200 and completely removing it from the elevator car. To move from the first position (FIGS. 2A, 2B) to the second position (FIGS. 2C, 2D), the chassis 202 is configured to be movable relative to the elevator car. For example, as shown, the car mounted governor assembly 200 is moved or slid upward in the figures from FIG. 2A to FIG. 2C. Although shown and described herein as a sliding motion, those of skill in the art will appreciate that other configurations and/or movements are possible without departing from the scope of the invention. For example, in alternative embodiments, the chassis or other part(s) of the car mounted governor assembly may be configured to rotate, actuate, slide, displace, etc. to enable access to one or more parts of the car mounted governor assembly. Further, although described with particular first and second positions, those of skill in the art will appreciate that the first and second positions are not limited to the embodiments and configurations described herein. For example, in some embodiments, the first position may be the maintenance position, and the second position may be the operational position. Further, in alternative embodiments, the first and second positions may be based on the type of movement of the car mounted governor assembly or components thereof As shown in the figures, the chassis 202 is operationally mounted to a sleeve 228. The sleeve 228 is attached to or configured with a roller 230. The roller 230 is configured to slide along a rail 232. The rail 232 is fixedly mounted to the elevator upright 222. Thus, the chassis 202, and the car mounted governor assembly 200, may slidably move from the first position (FIGS. 2A, 2B) to the second position (FIGS. 2C, 2D) along the rail 232 relative to the elevator upright 222. In alternative embodiments, the chassis 202 and the sleeve 228 may be formed as an integral piece, or in other embodiments, the chassis 202 may be configured to movably engage with the rail 232.

When the fastener(s) 224 are installed or engaged, the chassis 202 may not move relative to the upright 222, and the chassis 202 is fixed in the first position. However, when the fastener(s) 224 are removed or disengaged, the chassis 202 may be moved to the second position. When in the second position, the chassis 202, and thus the car mounted governor assembly 200 or a portion thereof is configured to be above the top of the elevator car 226. This allows for access to the components and features of the car mounted governor assembly 200 without disassembly of the assembly 200.

After an operation, such as a maintenance and/or inspection operation, is performed with the car mounted governor assembly 200 in the second position (FIGS. 2C, 2D), the chassis 202 may be slid or moved back to the first position (FIGS. 2A, 2B). The sliding or moving of the car mounted governor assembly 200 back to the first position is along the rail 232 by means of the roller 230 and sleeve 228. To stop the chassis 202 and locate the chassis 202 in the proper position such that the fastener(s) 224 may be replaced and lock the car mounted governor assembly 200 in the first position and to prevent the chassis 202 from moving too far, the stop 234 is provided on the elevator car upright 222.

As noted above, the second position (shown in FIGS. 2C and 2D) is not limited to that shown in the figures. For example, in some embodiments, the maintenance position may be lower than the operational position, or may be a rotated or pivoted position wherein the car mounted governor assembly is accessible from the interior of the elevator car, rather than the exterior, as described above.

Further, although stop 234 is shown and described as a supporting member, i.e., below the chassis 202, those of skill in the art will appreciate that the stop does not need to function as a support, and may be configured to merely enable positioning of the car mounted governor assembly in the correct spot (first position) after maintenance (second position) is performed. In such embodiments, the fasteners 224 may be configured to support the car mounted governor assembly 200 in the position and with sufficient strength such that the car mounted governor assembly 200 can operate appropriately and adequately as intended.

Figure 3:
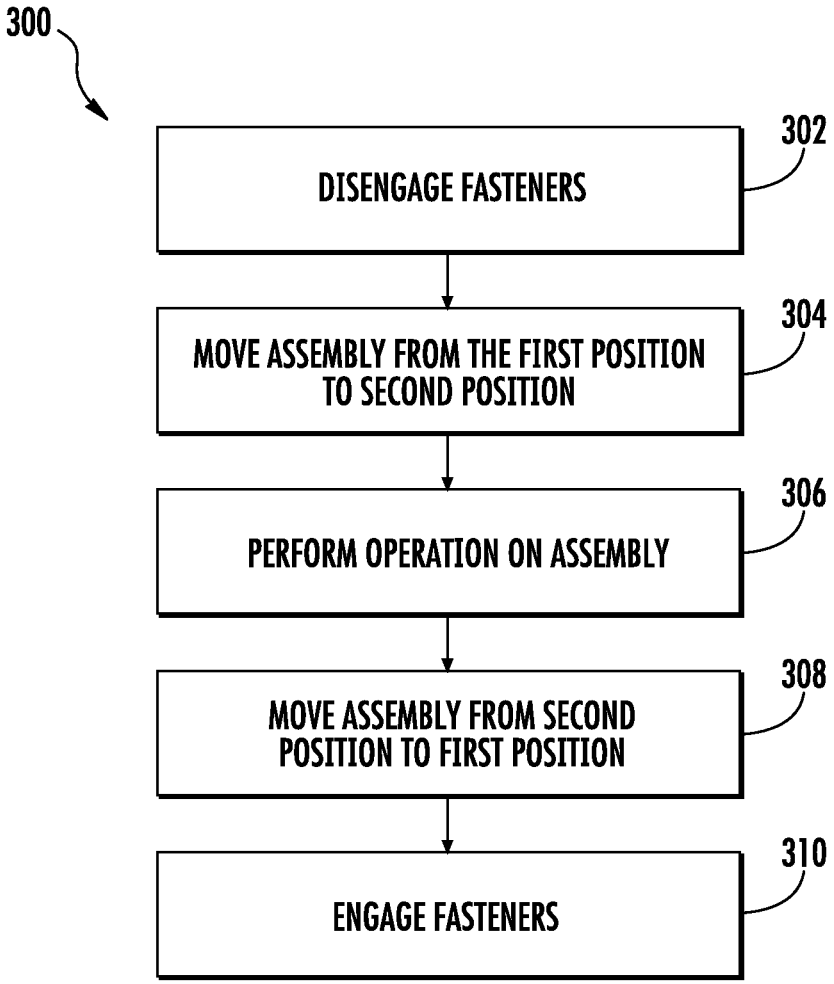
FIG. 3 is a process of accessing a car mounted governor assembly in accordance with an exemplary embodiment of the invention.

Turning now to FIG. 3, a process 300 of operating a movable car mounted governor assembly is shown. At step 302, one or more fasteners are disengaged to release a car mounted governor assembly from a first position. The disengagement may involve complete removal of the fastener from the assembly, or in other embodiments may involve a release from an engagement position. At step 304, the car mounted governor assembly is moved from the first position to a second position. At step 306, a maintenance operation may be performed on the car mounted governor assembly, while in the second position. At step 308, the car mounted governor assembly is moved from the second position back to the first position. At step 310, the one or more fasteners are engaged to secure the car mounted governor assembly in the first position.

Thus, in accordance with embodiments of the invention, a car mounted governor assembly may be located such that it operates to perform a safety feature of an elevator, but also enables easy access to the car mounted governor assembly when needed. Specifically, a reduced dimensioned, releasably/movably mounted chassis of a car mounted governor assembly is provided that can be engaged or locked in a first position, released, and moved to a second position.

Advantageously, embodiments of the invention provide a reduced volume/area car mounted governor assembly that enables use of more space of the hoistway dimensions, so with the same hoistway, it is possible to offer a larger elevator cabin. Further, such reduced dimensions of the car mounted governor assembly takes up or occupies less area or volume in height (hoistway), and thus allows for a better clearance or operational volume above a ceiling of an elevator car.

Further, advantageously, for maintenance and/or inspection operations, car mounted governor assemblies in accordance with embodiments of the invention enable a faster, safer, and easier to reach car mounted governor assembly. Thus, the costs, time, and difficulties associated with maintenance and/or inspection operations may be reduced. Furthermore, embodiments of the invention provide a car mounted governor assembly that does not require disassembly when performing maintenance/inspection operations.

While the invention has been described in detail in connection with only a limited number of embodiments, it should be readily understood that the invention is not limited to such disclosed embodiments. Rather, the invention can be modified to incorporate any number of variations, alterations, substitutions, combination, sub-combination, or equivalent arrangements not heretofore described, but which are commensurate with the spirit and scope of the invention. Additionally, while various embodiments of the invention have been described, it is to be understood that aspects of the invention may include only some of the described embodiments.

For example, although described herein with a roller-rail configuration for enabling the movability of the car mounted governor assembly, those of skill in the art will appreciate that other configurations are possible without departing from the scope of the invention. For example, in some embodiments, the roller-rail configuration may be eliminated entirely, and the car mounted governor assembly may be able to be removed by hand when moving from the first position to the second position.

Accordingly, the invention is not to be seen as limited by the foregoing description, but is only limited by the scope of the appended claims.

What is claimed is:

1. A movable car mounted governor assembly for an elevator car, the assembly comprising:

a chassis releasably mounted to an upright of an elevator car;

a governor operationally mounted to the chassis;

the chassis configured to move from a first position to a second position relative the upright, wherein in the first position the chassis is fixedly secured to the upright and in the second position the chassis is not fixedly secured to the upright, and wherein the second position is a maintenance position of the governor.

2. The assembly of claim 1, wherein the first position is an operational position of the governor.

3. The assembly of claim 1, wherein the second position is configured to enable access to the governor from an interior of the elevator car.

4. The assembly of claim 1, further comprising a roller operationally connected to the chassis and configured to enable the chassis to slide relative to the upright between the first and second positions.

5. The movable car mounted governor assembly of claim 4, wherein the roller is configured to slide along a rail that is fixed to the upright.

6. The assembly of claim 1, wherein a top of the chassis is substantially level with a top of the elevator car when in the first position.

7. The assembly of claim 1, further comprising at least one fastener configured to fixedly secure the chassis in the first position and being disengageable to enable the chassis to move to the second position.

8. The assembly of claim 1, further comprising a stop configured to locate the chassis in the first position.

9. The assembly of claim 8, wherein the stop is configured to support the chassis in the first position.

10. The assembly of claim 1, wherein the movement of the chassis is a rotation from the first position to the second position.

11. The assembly of claim 1, wherein the movement of the chassis is a vertical sliding motion from the first position to the second position.

12. A method of accessing a car mounted governor assembly of an elevator car, the method comprising:

disengaging at least one fastener to release a car mounted governor assembly from an upright of an elevator car;

moving the assembly from a first position to a second position with respect to the upright;

moving the assembly from the second position to the first position; and reengaging the at least one fastener to fixedly secure the assembly to the upright, wherein the first position is an operational position of the governor and the second position is a maintenance position of the governor.

13. The method of claim 12, wherein the steps of moving comprise at least one of (i) slidably moving and (ii) rotating the chassis between the first and second positions.

14. A movable car mounted governor assembly for an elevator car, the assembly comprising:

a chassis releasably mounted to an upright of an elevator car;

a governor operationally mounted to the chassis;

the chassis configured to move from a first position to a second position relative the upright, wherein in the first position the chassis is fixedly secured to the upright and in the second position the chassis is not fixedly secured to the upright, wherein the second position is configured to enable access to the governor from an interior of the elevator car.

15. The assembly of claim 14, further comprising a roller operationally connected to the chassis and configured to enable the chassis to slide relative to the upright between the first and second positions.

16. The assembly of claim 14, wherein a top of the chassis is substantially level with a top of the elevator car when in the first position.

17. The assembly of claim 14, further comprising at least one fastener configured to fixedly secure the chassis in the first position and being disengageable to enable the chassis to move to the second position.

18. The assembly of claim 14, further comprising a stop configured to locate the chassis in the first position.

19. The assembly of claim 14, wherein the movement of the chassis is a rotation from the first position to the second position.

20. The assembly of claim 14, wherein the movement of the chassis is a vertical sliding motion from the first position to the second position.

* * * * *